United States Patent [19]

Kolbe et al.

[11] Patent Number: 4,665,910

[45] Date of Patent: May 19, 1987

[54] RESPIRATOR HAVING A RESPIRATORY REGENERATOR WITH AN AREA COOLING PORTION

[75] Inventors: Ernst-Günter Kolbe, Mölln; Hasso Weinmann, Lübeck; Wolfgang Drews, Bahrenhof; Wolfgang Eckstein, Sereetz, all of Fed. Rep. of Germany

[73] Assignee: Drägerwerk AG, Fed. Rep. of Germany

[21] Appl. No.: 795,192

[22] Filed: Nov. 5, 1985

[30] Foreign Application Priority Data

Nov. 24, 1984 [DE] Fed. Rep. of Germany ..... 3442882

[51] Int. Cl.[4] ..... A62B 7/08

[52] U.S. Cl. ..... 128/202.26; 128/204.15; 128/205.17

[58] Field of Search ..... 128/202.26, 205.17, 128/205.72, 206.15, 206.17, 205.27, 205.28, 204.15

[56] References Cited

U.S. PATENT DOCUMENTS

| | | | |
|---|---|---|---|
| 3,938,512 | 2/1976 | Mausteller et al. | 128/202.26 |

FOREIGN PATENT DOCUMENTS

| | | | |
|---|---|---|---|
| 1234134 | 2/1967 | Fed. Rep. of Germany | 128/205.27 |
| 2057093 | 5/1972 | Fed. Rep. of Germany | 128/205.28 |
| 585638 | 8/1978 | U.S.S.R. | 128/202.26 |

*Primary Examiner*—Henry J. Recla

*Attorney, Agent, or Firm*—McGlew and Tuttle

[57] ABSTRACT

A respirator with regeneration of the respiratory air includes, for the cooling of the inhalation air, a chemical cartridge regenerating the respiratory air which has an area cooler located in the respiratory air stream, which cooler is arranged adjacent to and spaced from the surface of the chemical cartridge.

3 Claims, 3 Drawing Figures

RESPIRATOR HAVING A RESPIRATORY REGENERATOR WITH AN AREA COOLING PORTION

FIELD AND BACKGROUND OF THE INVENTION

This invention relates in general to respirators and in particular to a new and useful respirator which includes a housing having a chemical cartridge for liberating oxygen and binding carbon dioxide and a breathing gas passage with a breathing connection at one end and a portion of the passage which provides an area cooler.

The invention relates to a respirator with regeneration of the respiratory air through a chemical cartridge binding $CO_2$, which cartridge is arranged in the respiration path between a breathing connection and a breathing bag.

Such a respirator has become known from German OS 25 04 881. In the known respirator the chemical cartridge is arranged between a breathing connection and a breathing bag, so that at horizontal flow through the chemical cartridge the exhaled air flows into the breathing bag. During inhalation, the air is returned from the breathing bag into the breathing connection via the check valve while by-passing the chemical cartridge. Such a respirator is used in so-called circulation operation. As the exhaled air flows through the chemical cartridge, an exothermic reaction takes place through which $CO_2$ is bound and $O_2$ given off. The warmed exhalation air thus regenerated is cooled during its stay in the breathing bag to a temperature such that the wearer can inhale it again. Disadvantageous in respirators in circulation operation is the fact that they require for the return of the inhaled air special channels or chambers separated from the air conduction of the exhalation air. To avoid this, it is known to operate respirators in the pendulum system. Here the inhalation air as well as the exhalation air pass through the chemical cartridge. Then, however, heat exchangers must be provided between the chemical cartridge and the breathing connection for the cooling of the inhalation air. Such heat exchangers are known for example from German PS 335 931 and from German GM 19 81 991. However, if these known heat exchangers would, as is readily possible, be connected to a respirator which with omission of the inhalation air return ducts necessary for respiration in circulation operation had been modified into a respirator for pendulum operation, the known advantage of the compact and space-saving respirators easy to handle for the user would be lost through the expensive, heavy and space-requiring heat exchangers.

SUMMARY OF THE INVENTION

The present invention provides an improved respirator in such a way that a heat exchanger necessary for the pendulum operation does not influence its compact structural form.

In accordance with the invention, the respiratory air stream is provided with an area cooler which is arranged adjacent to and spaced from the surface of the chemical cartridge.

The advantage of a respirator according to the invention resides in that also for use in pendulum operation it has a compact structural form which enables the user to carry the respirator both in the packed state without bulky projection at the body, as well as for use in a simple manner directly before the user's mouth, without impairing his freedom of movement through excessive weight or cantilevered structural form any more than is the the case with the known respirators in circulation operation.

In particularly advantageous manner the area cooler may be designed so that it is arranged in the form of flat and wide conduit passages around the jacket of the chemical cartridge, a certain distance from the jacket being maintained, to prevent heating of the area cooler and to ensure its being completely swept by ambient air. By this advantageous arrangement of the area cooler, the respirator is merely enlarged slightly at the circumference of the chemical cartridge.

To emply the respirator in the circulation mode, the area cooler may, in a further development of the invention, be arranged as a by-pass connection between the breathing bag and the breathing connection, and it may contain a check valve. Thereby the cooling of the inhalation air as it exists in circulation respirators due to the breathing bag is increased still further by the area cooler.

For more convenient wearing of the respirator it is provided that below the breathing connection a chin support is provided.

The head strap, so as to realize a compact structural form of the respirator is fasted to the surface of the chemical cartridge.

Accordingly it is an object of the invention to provide an improved respirator which includes a chemical cartridge for liberating oxygen and binding carbon dioxide arranged with a breathing gas passage connected to one side of the cartridge passage of breathing gases through the cartridge and into a breathing bag at the opposite side and for a return back through the cartridge and the breathing passage and which has a portion spaced from the cartridge which provides an area cooler for the breathing gases.

A further object of the invention is to provide a respirator which is simple in design, rugged in construction and economical to manufacture.

The various features of novelty which characterize the invention are pointed out with particularity in the claims annexed to and forming a part of this disclosure. For a better understanding fo the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
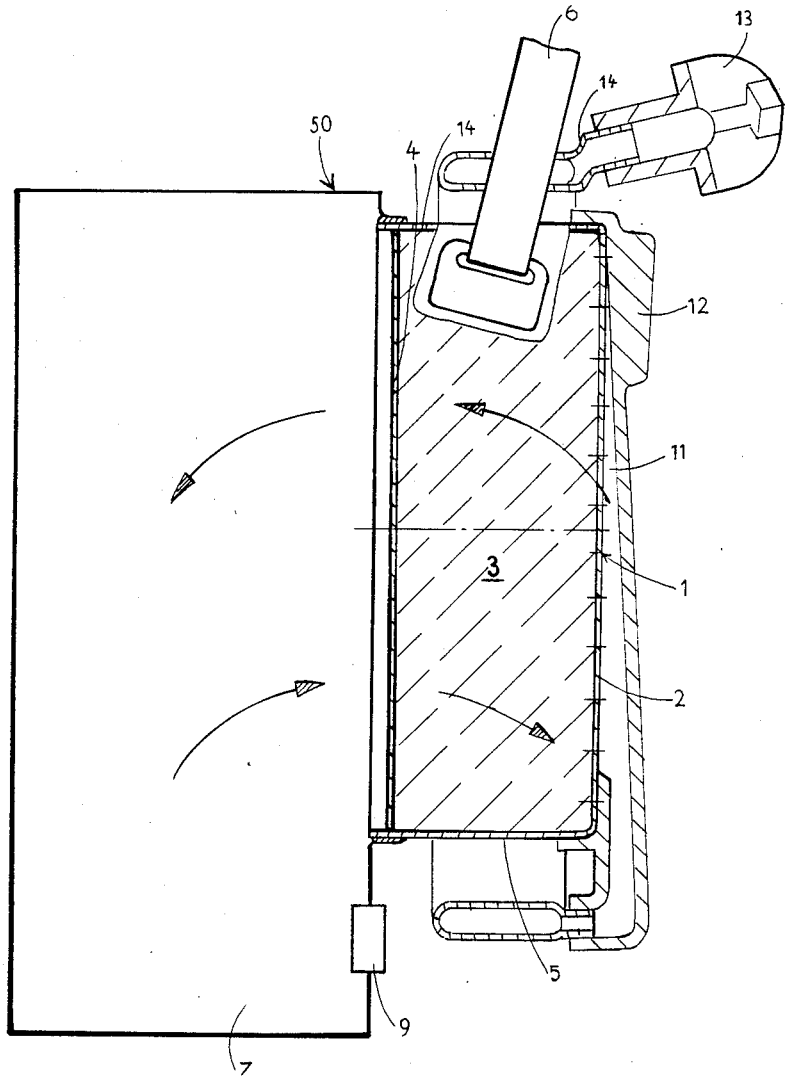
FIG. 1 is a partial elevational view of a section of a respirator in pendulum operation in accordance with the invention.
Figure 2:
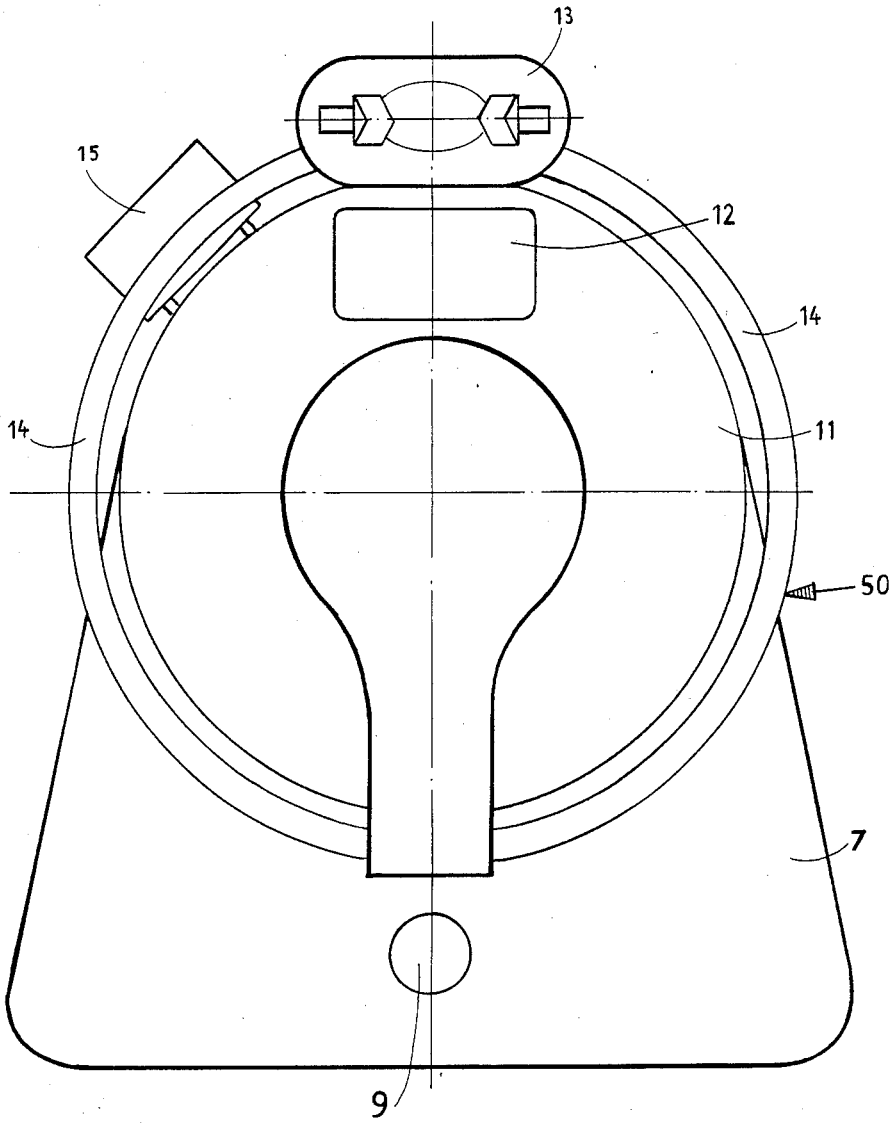
FIG. 2 is an end elevational view of the respirator according to FIG. 1.

Referring to the drawings in particular, the invention embodied therein comprises a respirator having a housing generally designated 50 which includes a cartridge 3 having a front end 2 and an opposite rear end 4. Respiratory air is circulated through a respiratory air passage 11 of the housing which has a breathing connection 13 at one end which is adapted to fit in the wearer's mouth and includes an annular tubular portion 14 which defines an area cooler for the respiratory gases spaced from the cartridge 3 and advantageously extends around it.

The respirator in pendulum operation includes a chemical cartridge 1, having a front end face 2. The cartridge 1 is surrounded by an area cooler 14 with a breathing connection 13.

The cartridge has a rear end face 4 on which a breathing bag 7 is fastened. The respirator has a head strap 6 for supporting it around a person's neck. At the breathing bag 7 an overpressure valve 9 is provided which vents to atmosphere in the event of an overpressure. A starter 15 is in connection with the chemical cartridge 1 and it supplies the oxygen needed during the first few minutes to aid a burn-off of a chemical filling 3.

Figure 3:
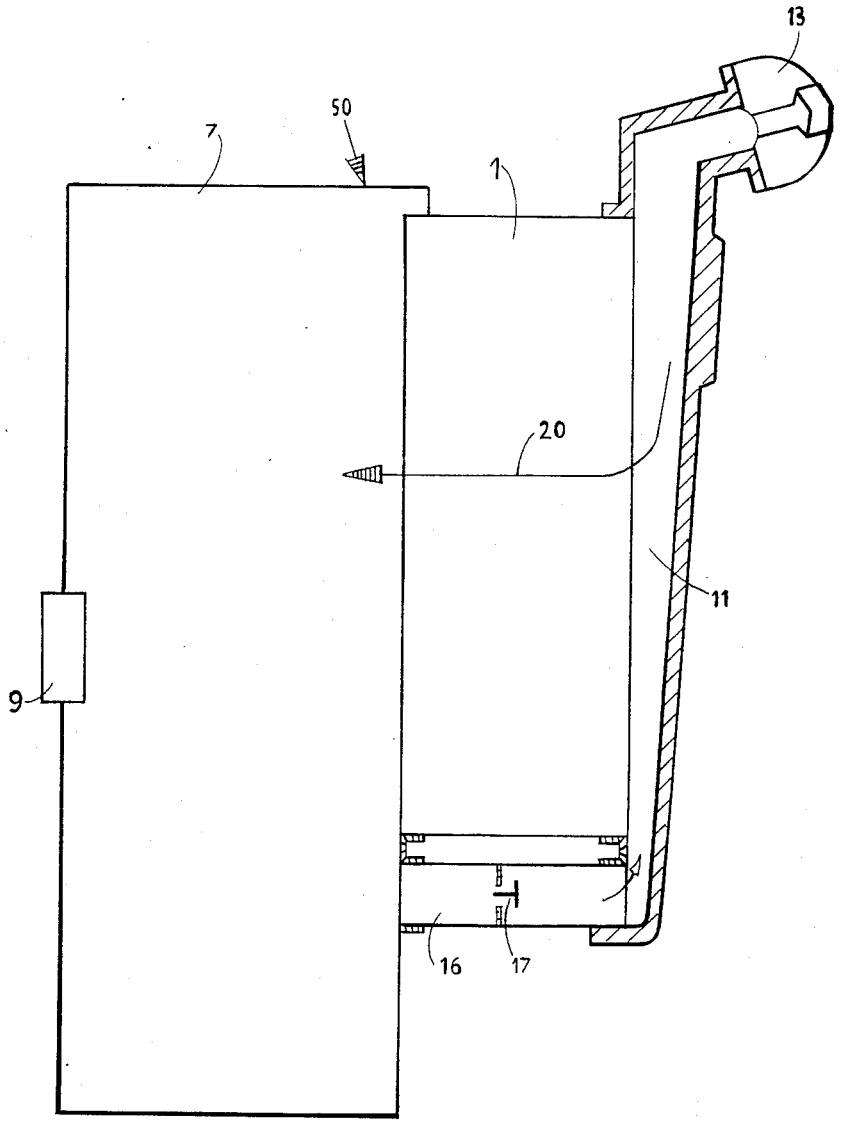
FIG. 3 is a partial schematic sectional view similar to FIG. 1 but showing the device in circulation operation.

In operation, the wearer exhales through the breathing connection 13 into a conduit or passage 11 of the area cooler 14 arranged annularly spaced from a peripheral surface 5 of the chemical cartridge 1. The exhaled air goes into the passage 11 and thence through the chemical filling 3 into the breathing bag 7 as shown by arrow 20 in FIG. 3.

By the chemical filling 3, $CO_2$ is drawn out of the exhalation air through an exothermic reaction and $O_2$ is given off to it. During the inhalation, the respiratory air enriched with $O_2$ is conducted out of the breathing bag 7 again through the chemical cartridge 1 into the passage 11. During the passage through the chemical filling 3, the inhalation air absorbs a part of the heat of reaction. This reaction heat, however, is given off to the surrounding again during flow back through the area cooler 14.

The passage 11 has a flat conduit cross-section which proves to be an additional advantage since it provides for a minimum dead space volume for the respiration.

For easier retention of the respirator a chin support 12 is provided at the antechamber 11.

In the respirator for circulation operation, there is provided, at the antechamber 11 which is part of the area cooler 14, a by-pass line 16 which provides a connection to the breathing bag 7. To make sure that during operation only the exhaled air is passed through the chemical cartridge 1 and the inhaled air enters the antechamber 11 via the by-pass line 16, a check valve 17 set for a predetermined pressure is provided in the by-pass line 16. Since in circulation operation the breathing bag 7 provides for the essential cooling of the inhalation air, the area cooler 16 may comprise a simple conduit.

While a specific embodiment of the invention has been shown and described in detail to illustrate the application of the principles of the invention, it will be understood that the invention may be embodied otherwise without departing from such principles.

What is claimed is:

1. A respirator comprising a housing having a chemical oxygen liberating and carbon dioxide binding cartridge therein with front and rear walls and a peripheral wall connected between said front and rear walls, said front and rear walls defining a respiratory gas flow passage therethrough, a breathing bag connected to said housing and covering said rear wall, an annular tubular area cooler disposed around and spaced outwardly from said peripheral wall, a breathing connection inserted into the mouth of a user and connected to a top portion of said cooler, a front part overlying said front wall and defining a respiratory air passage therewith, a bottom portion of said cooler being connected to said front part and communicating with said air passage.

2. A respirator according to claim 1, wherein front part has a chin support adjacent said breathing connection.

3. A respirator according to claim 1, including a head strap connected to said cartridge housing and providing a connection for supporting the respirator on a person's neck.

* * * * *